US009199123B2

(12) United States Patent
Solow et al.

(10) Patent No.: US 9,199,123 B2
(45) Date of Patent: Dec. 1, 2015

(54) EXERCISE TABLE

(71) Applicants: Howard Solow, Boulder, CO (US); John Baudhuin, Santa Monica, CA (US)

(72) Inventors: Howard Solow, Boulder, CO (US); John Baudhuin, Santa Monica, CA (US)

( * ) Notice: Subject to any disclaimer, the term of this patent is extended or adjusted under 35 U.S.C. 154(b) by 0 days.

(21) Appl. No.: 13/668,148

(22) Filed: Nov. 2, 2012

(65) Prior Publication Data

US 2013/0196835 A1 Aug. 1, 2013

Related U.S. Application Data

(60) Provisional application No. 61/554,896, filed on Nov. 2, 2011.

(51) Int. Cl.

| | |
|---|---|
| ***A63B 26/00*** | (2006.01) |
| ***A63B 5/16*** | (2006.01) |
| ***A63B 17/04*** | (2006.01) |
| ***A63B 21/02*** | (2006.01) |
| ***A63B 21/055*** | (2006.01) |
| ***A63B 21/00*** | (2006.01) |
| ***A63B 22/00*** | (2006.01) |
| ***A63B 23/035*** | (2006.01) |

(Continued)

(52) U.S. Cl.

CPC . *A63B 26/00* (2013.01); *A63B 5/16* (2013.01); *A63B 17/04* (2013.01); *A63B 21/00065* (2013.01); *A63B 21/023* (2013.01); *A63B 21/0428* (2013.01); *A63B 21/0552* (2013.01); *A63B 21/156* (2013.01); *A63B 22/0089* (2013.01); *A63B 23/03525* (2013.01); *A63B 23/0405* (2013.01); *A63B 2071/025* (2013.01); *A63B 2208/0247* (2013.01)

(58) Field of Classification Search

CPC .. A63B 26/00; A63B 22/087; A63B 22/0089; A63B 22/20; A63B 22/201; A63B 22/203

USPC ..... 482/142–144

See application file for complete search history.

(56) References Cited

U.S. PATENT DOCUMENTS

| | | | |
|---|---|---|---|
| 1,621,477 | A | 3/1927 | Pilates |
| 1,738,987 | A | 12/1929 | Dattilo |

(Continued)

FOREIGN PATENT DOCUMENTS

| | | |
|---|---|---|
| CH | 332 368 | 10/1958 |
| CH | 369 404 | 5/1963 |

(Continued)

OTHER PUBLICATIONS

European Patent Office, Supplementary European Search Report, May 20, 2011, 4 pages, Munich, Germany.

(Continued)

*Primary Examiner* — Oren Ginsberg
*Assistant Examiner* — Megan Anderson
(74) *Attorney, Agent, or Firm* — Maceiko IP

(57) ABSTRACT

An improved exercise table or reformer having an improved tower, adjustable foot bar assembly and/or improved jump board. The improved tower may also be used without being attached to a reformer. The improved tower includes adjustable spring mechanisms and adjustable pulley mechanisms. The improved foot bar assembly includes a captive hook to improve safety. The improved jump board is attached to the frame by dropping into an envelope and by engaging the foot bar assembly.

10 Claims, 14 Drawing Sheets

(51) Int. Cl.

| | |
|---|---|
| ***A63B 23/04*** | (2006.01) |
| ***A63B 21/04*** | (2006.01) |
| *A63B 71/02* | (2006.01) |

(56) References Cited

U.S. PATENT DOCUMENTS

| | | | | |
|---|---|---|---|---|
| 1,934,389 | A | 11/1933 | Walter | |
| 2,733,922 | A | 2/1956 | Diego | |
| 3,658,327 | A | 4/1972 | Thiede | |
| 3,770,267 | A | 11/1973 | McCarthy | |
| 3,866,914 | A | 2/1975 | Jackson | |
| 4,023,818 | A | 5/1977 | Troller | |
| 4,706,953 | A | 11/1987 | Graham | |
| 4,884,802 | A | 12/1989 | Graham | |
| 5,066,005 | A | 11/1991 | Luecke | |
| 5,338,278 | A | 8/1994 | Endelman | |
| 5,364,327 | A | 11/1994 | Graham | |
| 5,607,381 | A | 3/1997 | Endelman | |
| 5,616,107 | A | 4/1997 | Simonson | |
| 5,653,670 | A | 8/1997 | Endelman | |
| 5,681,249 | A | 10/1997 | Endelman | |
| 5,772,560 | A | 6/1998 | Watterson et al. | |
| 5,792,033 | A | 8/1998 | Merrithew | |
| 5,807,217 | A | 9/1998 | Endelman | |
| 5,899,834 | A | 5/1999 | Dalebout et al. | |
| 6,045,491 | A | 4/2000 | McNergney et al. | |
| 6,120,425 | A | 9/2000 | Endelman | |
| 6,186,929 | B1 * | 2/2001 | Endelman et al. | 482/121 |
| 6,338,704 | B1 | 1/2002 | Endelman | |
| 6,371,895 | B1 | 4/2002 | Endelman et al. | |
| 6,394,933 | B1 | 5/2002 | Yu | |
| 6,461,408 | B2 | 10/2002 | Buxbaum | |
| 6,527,685 | B2 * | 3/2003 | Endelman et al. | 482/121 |
| 6,685,606 | B2 | 2/2004 | Endelman | |
| 6,926,650 | B2 | 8/2005 | Endelman et al. | |
| 6,971,976 | B2 | 12/2005 | Endelman et al. | |
| 7,104,937 | B2 | 9/2006 | Arbuckle et al. | |
| 7,125,368 | B2 | 10/2006 | Endelman | |
| 7,125,369 | B2 | 10/2006 | Endelman | |
| 7,125,370 | B1 | 10/2006 | Schaffner et al. | |
| 7,163,498 | B1 | 1/2007 | Abelbeck | |
| 7,163,500 | B2 | 1/2007 | Endelman et al. | |
| 7,270,628 | B2 | 9/2007 | Campanaro et al. | |
| 7,288,053 | B2 | 10/2007 | Endelman et al. | |
| 7,288,054 | B2 | 10/2007 | Endelman et al. | |
| 7,294,098 | B2 | 11/2007 | Barnard et al. | |
| 7,306,549 | B2 | 12/2007 | Francis | |
| 7,465,261 | B2 | 12/2008 | Barnard et al. | |
| 7,674,211 | B2 | 3/2010 | Uygan | |
| 7,682,297 | B2 | 3/2010 | Graham | |
| 7,850,584 | B2 * | 12/2010 | Uygan | 482/130 |
| 7,857,736 | B2 | 12/2010 | Merrithew | |
| 8,137,247 | B2 * | 3/2012 | Gerschefske et al. | 482/96 |
| 8,506,462 | B2 * | 8/2013 | Gregor et al. | 482/142 |
| 2001/0056011 | A1 | 12/2001 | Endelman et al. | |
| 2002/0058573 | A1 * | 5/2002 | Endelman et al. | 482/142 |
| 2002/0151419 | A1 | 10/2002 | Barnes et al. | |
| 2003/0119635 | A1 | 6/2003 | Arbuckle | |
| 2003/0119636 | A1 | 6/2003 | Endelman | |
| 2004/0176227 | A1 | 9/2004 | Endelman | |
| 2005/0113227 | A1 | 5/2005 | Endelman et al. | |
| 2006/0199712 | A1 | 9/2006 | Barnard | |
| 2006/0252616 | A1 * | 11/2006 | Gerschefske | 482/142 |
| 2006/0287170 | A1 * | 12/2006 | Gerschefske et al. | 482/94 |
| 2006/0293156 | A1 | 12/2006 | Trees | |
| 2007/0087921 | A1 | 4/2007 | Graham | |
| 2008/0248935 | A1 | 10/2008 | Solow et al. | |
| 2009/0247376 | A1 | 10/2009 | Merrithew et al. | |
| 2010/0004101 | A1 | 1/2010 | Solow et al. | |
| 2010/0323857 | A1 * | 12/2010 | D'Silva et al. | 482/121 |
| 2011/0172069 | A1 * | 7/2011 | Gerschefske et al. | 482/139 |

FOREIGN PATENT DOCUMENTS

| | | |
|---|---|---|
| DE | 17 89 189 | 5/1959 |
| DE | 16 58 736 | 11/1970 |
| DE | 33 13 839 | 11/1984 |
| EP | 0 174 896 | 3/1986 |
| FR | 2 625 907 | 7/1989 |
| FR | 2 661 155 | 10/1991 |
| WO | WO 02/083251 | 10/2002 |
| WO | WO 03/081987 A1 | 10/2003 |
| WO | WO 2005/051496 A2 | 6/2005 |
| WO | WO 2009/061321 | 5/2009 |

OTHER PUBLICATIONS

PCT, International Search Report, Sep. 17, 2003, 3 pages.

PCT, International Search Report and Written Opinion, Mar. 29, 2013, 10 pages.

Pilates, Pilates Allegro® Reformer, www.pilates.com, Oct. 22, 2010, 2 pages.

Stott Pilates, SPX Max Reformer, http://store.stottpilates.com, Oct. 22, 2010, 2 pages.

* cited by examiner

EXERCISE TABLE

CROSS REFERENCE TO RELATED APPLICATION

This application claims the benefit of U.S. Provisional Application No. 61/554,896, filed Nov. 2, 2011.

FIELD OF THE INVENTION

The current invention generally relates to exercise equipment, including an improved exercise table or "reformer" with improved strength, adjustability, appearance and/or safety to be used in pilates or other types of exercises.

BACKGROUND OF THE INVENTION

Exercise and other efforts to improve physical fitness and general health have become increasing popular. Many different forms of exercise and fitness routines have come into being such as aerobics, weight training, yoga and more recently, exercises related to pilates, gyrotonics and the like. Pilates has become increasingly popular since it provides a unique blend of training to improve flexibility, strength and aerobic stamina.

Various forms of exercise may be performed without the use of any equipment, while other forms may require basic or specialized equipment. Many exercises associated with pilates involve an exercise table that is commonly referred to as a reformer. A reformer typically includes a frame which supports a platform or carriage that may move back and forth along the frame's length. A user may lie, kneel or assume some other body position on the platform. Springs are typically connected to the platform and extend to the frame where one or more of the springs are typically attached to adjust the resistance to be experienced by the user. The user may press against the frame with his or her hands or feet, and thereby move the platform away from the end of the frame against the spring's resistance. The bias of the springs will then tend to move the carriage so that it returns to its original position, and the user may exert resistance to control this return motion. The carriage thus moves back and forth along the length of the frame.

Typical reformers include a foot bar which extends upward from the foot end of the frame and against which the user may apply pressure to move the platform away from the foot end against the spring's resistance. Typical reformers also include handles attached to ropes which the user may also pull to move the platform against the spring's resistance.

Certain reformers may also include an upright member sometimes referred to as a tower. The tower may include what is known as a push through bar, and springs and/or pulleys may also be attached to the tower. The tower attachment allows the user to perform different types of exercises.

An attachment known as a jump board may also be attached to the reformer. Typically, the user presses against the jump board with enough force so that the carriage (and the user) moves from the foot end to the head end of the reformer so that the user's feet separate from the jump board. The bias of the springs then returns the carriage to the foot end, and the user's feet may then "land" on the jump board and "jump" off of it again for another repetition.

Many pilates studios have one or more reformers that are used by different people. Sometimes, a given reformer will be used by numerous people in a given day. The height and body proportions, such as leg and torso lengths, may vary between users, sometimes significantly. This, as well as the various types of exercises that may be performed on a given reformer, typically requires the springs to be adjusted, both in the number of springs that are used to provide a certain resistance and/or the placement of springs on the tower. The location of the pulleys is also typically adjusted as well. Therefore, it is important that reformers be easily adjustable, and once adjusted, sturdy so that the user may safely perform his or her exercise routine.

The towers on some current reformers are made from off-the-shelf tubular metal and connection fittings that are typically used with light rigging. Towers made of such components may be less sturdy than ideal, and may become weaker over time. Furthermore, certain towers may not be solidly connected to the reformer or other type of exercise equipment. Still further, such towers may only offer certain, fixed locations at which to attach springs and/or pulleys. And adjustment of the location at which a spring or pulley connects to the tower may involve a cumbersome process of detaching a connector and then reattaching the connector at a new location. Oftentimes, this includes unscrewing a loop fitting, repositioning the spring and then tightening the loop fitting again. This is disadvantageous because in pilates and other forms of exercise, the "flow" or ease in which the user may perform one exercise after another is important. Accordingly, there is a need for an improved tower for use with reformers and other exercise equipment.

As noted above, reformers typically include a foot bar for the user to press against, e.g., as the carriage moves from the foot end to the head end. Certain types of current foot bars may be designed in such a way that may allow the foot bar to become disengaged during an exercise routine. This may create a safety hazard. Accordingly, there exists a need for an improved foot bar that is solidly locked in place during the exercise, but may still be readily adjusted.

As noted above, a jump board may be attached to certain current reformers. However, existing jump boards oftentimes require cumbersome attachment means such as threaded knobs that must be screwed into the reformer frame. And if the knobs are not adequately screwed in, the jump board may become loose during exercise leading to a safety issue. The jump board may also be less sturdy than ideal. Accordingly, there exists a need for a jump board that may be more readily attached to a reformer and that provides increased sturdiness and safety.

Existing reformers may also include sharp edges or surfaces that are not comfortable for a user to touch. Existing reformers may also appear industrial which may not be inviting for certain users. Accordingly, there is a need for a more user-friendly reformer or other type of exercise equipment.

SUMMARY OF THE INVENTION

The exercise table, or reformer, of the current invention addresses the foregoing and other issues.

In one aspect of the current invention, an improved tower is described. The tower may provide increased stability by using sturdy components that preferably provide rigidity and user safety. The tower may also provide quicker adjustment of springs and/or pulleys to allow better flow between exercises. The tower may also be attached to a reformer or to a wall or other supporting structure.

In another aspect of the current invention, an improved foot bar assembly is described. The foot bar preferably provides safe operation by limiting the foot bar's movement if it were to be inadvertently pulled or pushed in a direction opposite to the force typically applied during use. This in turn preferably prevents the foot bar from becoming disengaged. In a preferred embodiment, the foot bar may include adjustment links having cutouts and captive hooks that engage pegs extending from the reformer frame.

In another aspect of the current invention, an improved jump board and the manner in which the jump board is attached to a reformer is described. To this end, the jump board may be secured by a bracket, within the reformer frame and by the foot bar to provide increased safety for jump board exercises.

In another aspect of the current invention, an improved tactile feel and appearance of the exercise equipment is described. To this end, components of the reformer described herein are rigid and/or may be rubber coated to provide a sturdy apparatus. The tower aspect of the current invention may also include curved members having a matching appearance.

Other aspects, features and details of the present invention can be more completely understood by reference to the following detailed description of the preferred embodiments taken in conjunction the drawings and appended claims.

DETAILED DESCRIPTION OF THE PREFERRED EMBODIMENTS

Figure 1:
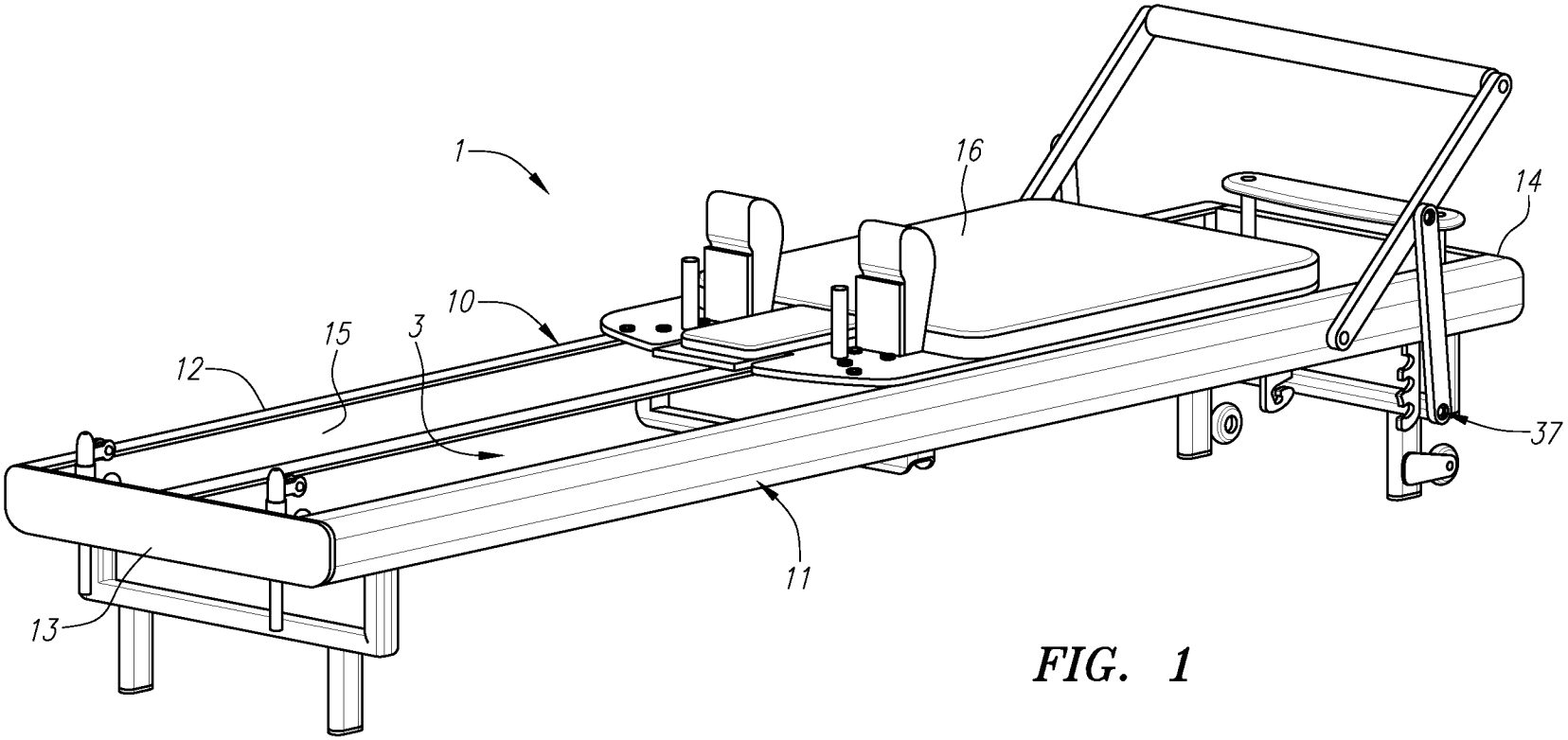
FIG. 1 is a perspective view of an exercise table.

Embodiments of the current invention will now be described with reference to the drawings. To facilitate the description, any reference numeral representing an element in one figure will represent the same element in any other figure. The current invention is not limited to the specific description below, as one skilled in the art will appreciate that variations may occur to the subject matter described below while still being within the scope and content of the current invention. The description below makes reference to reformers, but one skilled in the art will recognize that the current invention is suitable for use with other types of exercise equipment, such as equipment where springs or other forms of resistance are used and it may be desired to move the location at which the spring attaches to the equipment.

Referring to FIG. 1, an exercise table or reformer 1 typically used for certain pilates exercises is shown. Table 1 includes frame 10 that may be rectangular and extend about the periphery of table 1, thereby defining an open interior 3. Frame 10 may include side members, a head member and a foot member. More particularly, frame 10 may include a longitudinally extending right side member 11, a longitudinally extending left side member 12, a head member 13 and a foot member 14. The frame members 11, 12, 13, 14 may be attached together by any appropriate means.

Figure 2:
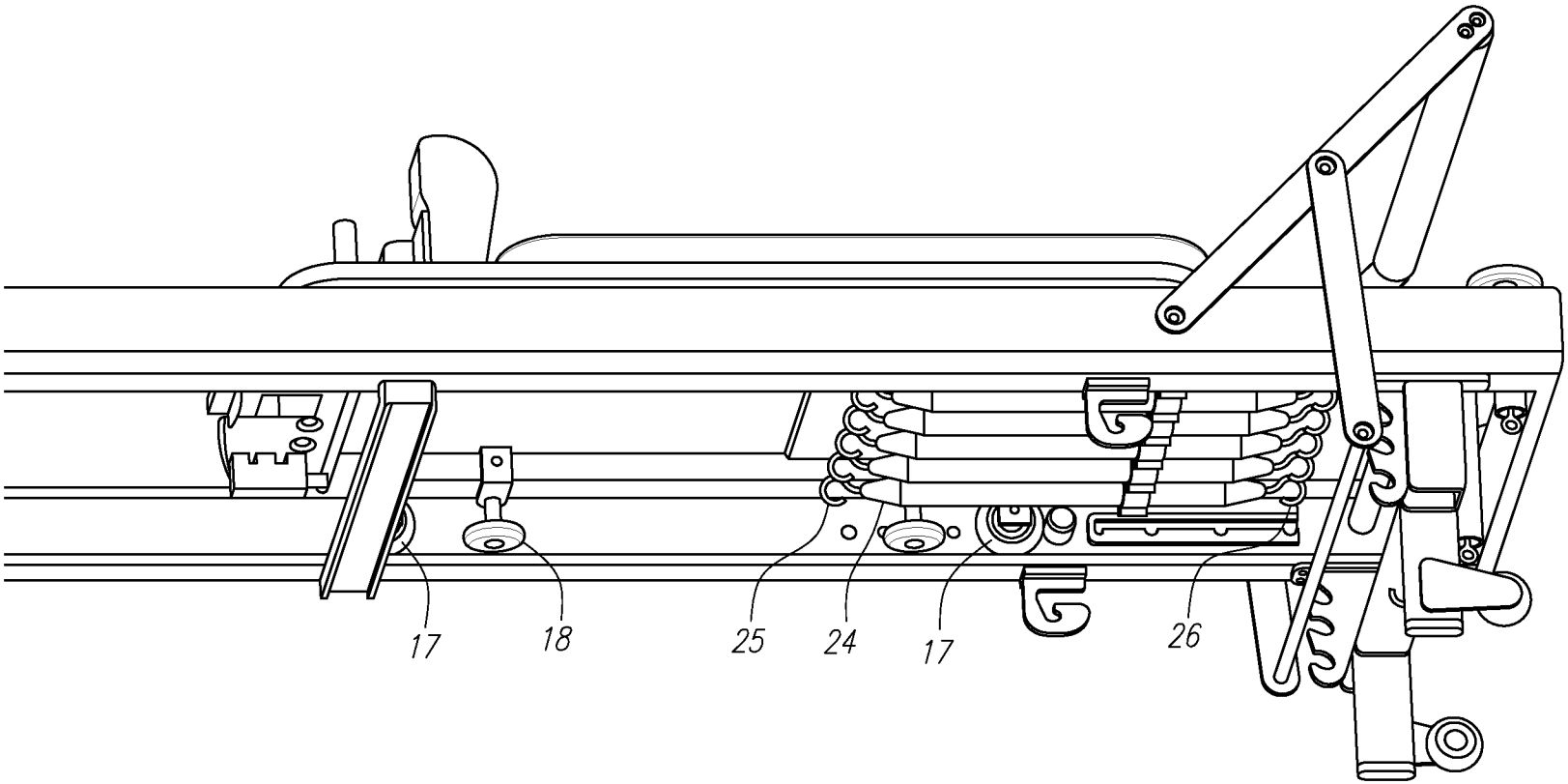
FIG. 2 is an underneath perspective view of an exercise table.

Exercise table or reformer 1 also includes a platform 16 on which the user lies or assumes some other body position, and which may longitudinally move back and forth along the sides of frame 10, as well as foot assembly 29 which includes foot bar 29*a* and links 30, 37. To this end, side frame members 11, 12 may include inwardly opening channels 15 as shown in FIGS. 1 and 2, which may define tracks in which vertical rollers may move. Channels 15 may comprise inward facing u-shaped flanges that include a bottom horizontal flange, a vertical wall attached to the side member 11 or 12, and an upper horizontal flange. In a preferred embodiment a channel 15 may be contiguous with a side member 11 or 12 such that they comprise a single piece. In other embodiments, channel 15 may be separate from side member 11 or 12 but may be attached thereto by suitable fastening means.

Vertical rollers 17 may engage the bottom horizontal flange and slide in the channel 15. Vertical rollers 17 may be attached to platform 16 by a bracket or other suitable device, and may support platform 16 at it moves along the length of frame 10 as shown in FIG. 2. As also shown in FIG. 2, horizontal rollers 18 contact the vertical wall of the inward channel 15 and may also be attached to and support platform 16. Horizontal rollers preferably help ensure that platform 16 moves in a straight line as it longitudinally articulates back and forth along frame 10.

Figure 3:
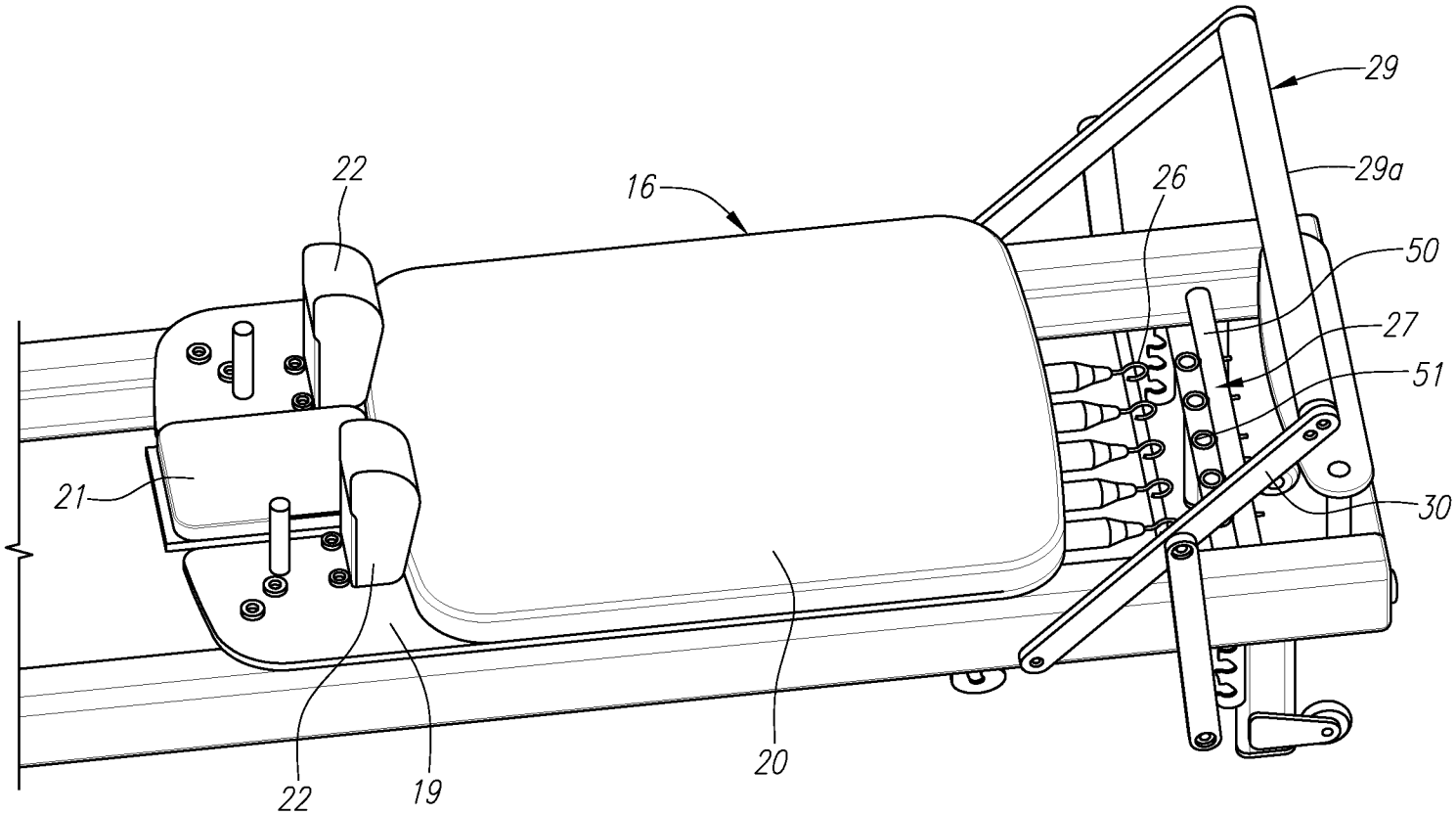
FIG. 3 is a top perspective view of an exercise table.

Platform 16 is now more specifically described with reference to FIG. 3. Platform 16 preferably includes a rigid structural panel 19 of generally rectangular configuration. Platform 16 is preferably designed to support the weight of the user and is sized to accommodate the trunks of larger users. Platform 16 preferably includes support cushion 20 to provide comfort to the user when he or she lies or kneels on it, or assumes some other body position thereon. Cushion 20 may be attached to panel 19 in any suitable manner.

Platform 16 and panel 19 may include a head end and foot end that correspond to the head end 13 and foot end 14 of frame 10. At the head end of the panel 19, an adjustable height head support 21 may be centrally positioned for supporting a user's head. Head support 21 may be arranged flat (as shown) or tilted up to place the user's neck in predetermined angles. A pair of shoulder blocks 22 may be located on either side of head support 21. Blocks 22 may support the shoulders or other body parts such as feet, hands or knees of the user depending upon the exercise being performed.

Figure 13:
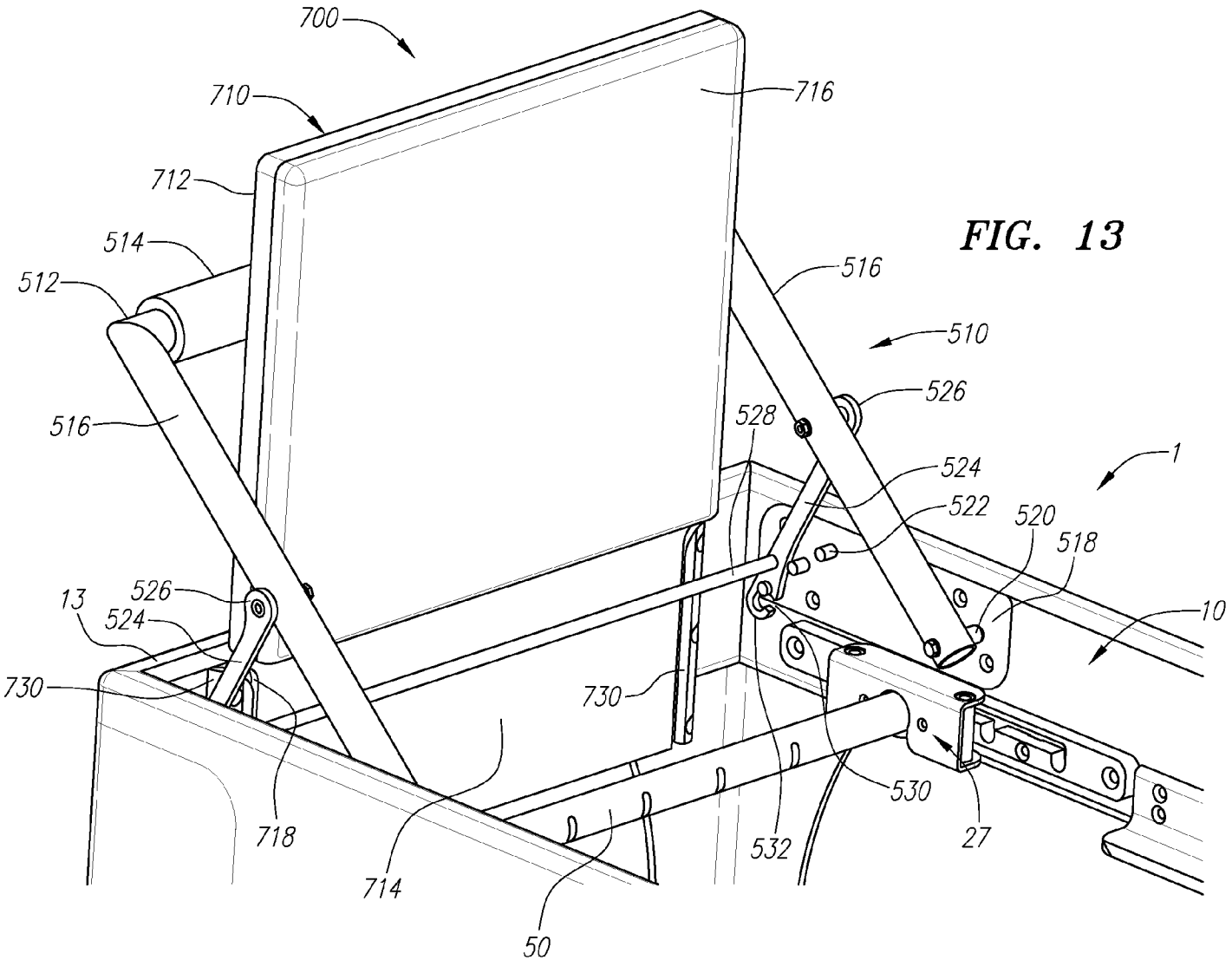
FIG. 13 is a front perspective view of a foot bar assembly and a jump board.

Referring again to FIG. 2, a plurality of resistance members 24 may be attached to platform 16 at their first ends 25. The current invention also contemplates using a single resistance member 24. In one embodiment, resistance members 24 comprise coil springs that are attached to the underneath of panel 19. The second ends 26 of springs 24 may be selectively attached to anchor bar assembly 27, so that different spring resistances may be experienced by the user. In FIG. 3, second ends 26 are not shown attached to anchor bar assembly because in practice, the number of springs attached to anchor bar assembly 27 will vary according to the strength of the user and the exercise being performed. In any event, and as shown in FIGS. 3 and 13, anchor bar assembly 27 may include a bar or rod 50 and a plurality of eyebolts 51 attached thereto. The second ends 26 of one or more springs 24 may be selectively attached to eyebolts 51 to suit the exercise and user. It should be noted that other suitable devices for attaching springs 24 to anchor bar assembly 27 may be used.

Other components and other aspects of the operation of an exercise table, such as a reformer, are described in U.S. Ser. Nos. 10/553,930; 11/652,806; 12/555,460 and 61/465,229, as well as U.S. Pat. No. 7,104,937, the disclosures of which are expressly incorporated by reference as if fully set forth herein. Exercise table 1 may also include a flat mat surface in addition to or instead of carriage 16. In this type of exercise table, the user may lay on the mat to perform different types of exercises.

An aspect of the current invention involving an improved tower 600 is now described with reference to FIGS. 4-12. The improved tower 600 of the current invention preferably provides increased stability when compared to typical current towers, and is easier to use and provides increased functionality by allowing, e.g., quicker adjustments of springs and/or pulleys. Preferably, this provides a better flow between exercises.

Tower 600 of the current invention may be attached to a reformer or other exercise equipment. Alternatively, tower 600 need not be attached to a reformer but instead may be attached to a wall. When attached to a wall, it is preferred that tower 600 be located a distance from the wall so that the push through bar may swing in both directions.

Figure 4:
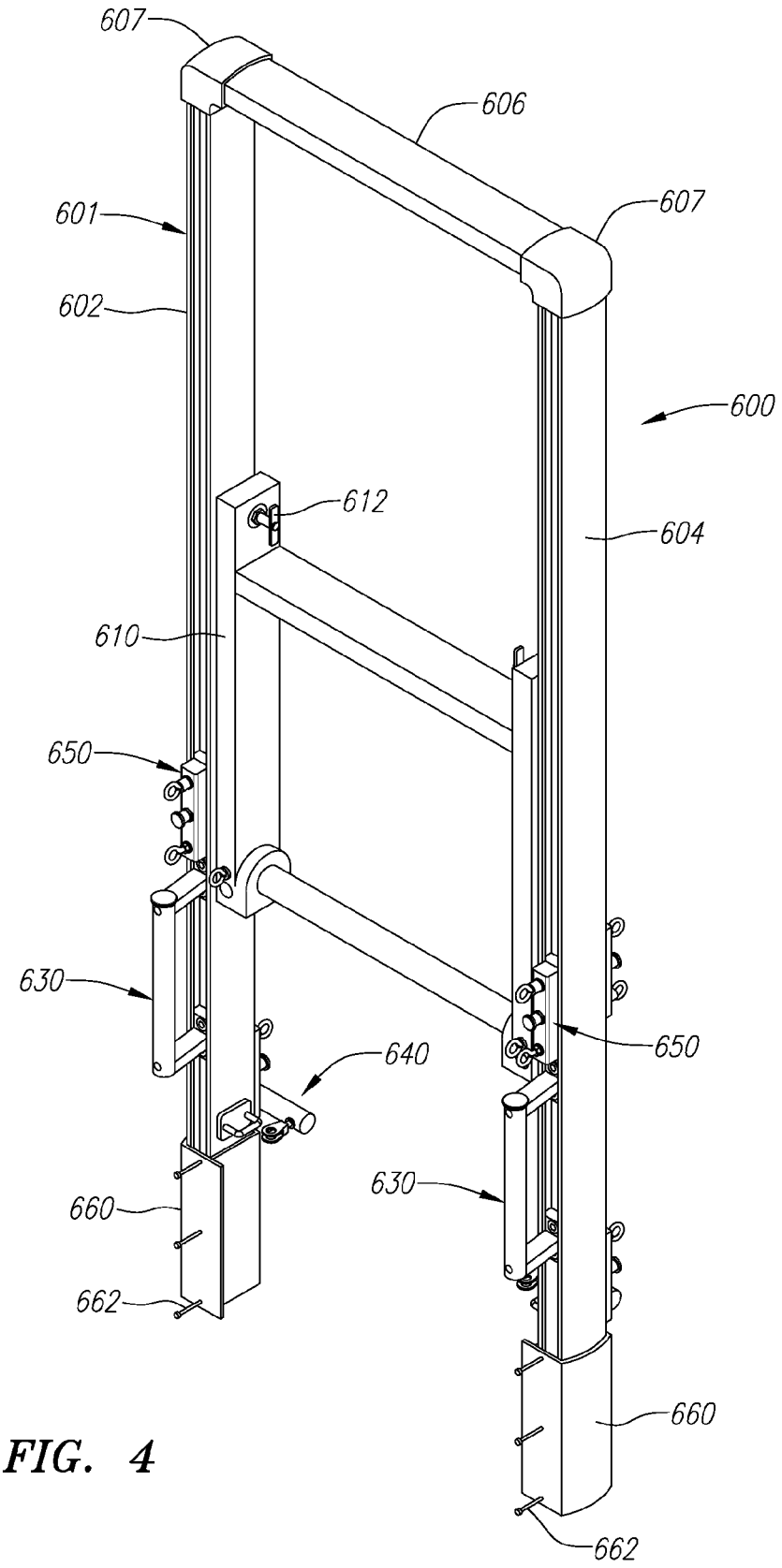
FIG. 4 is a front perspective view of a tower.
Figure 5:
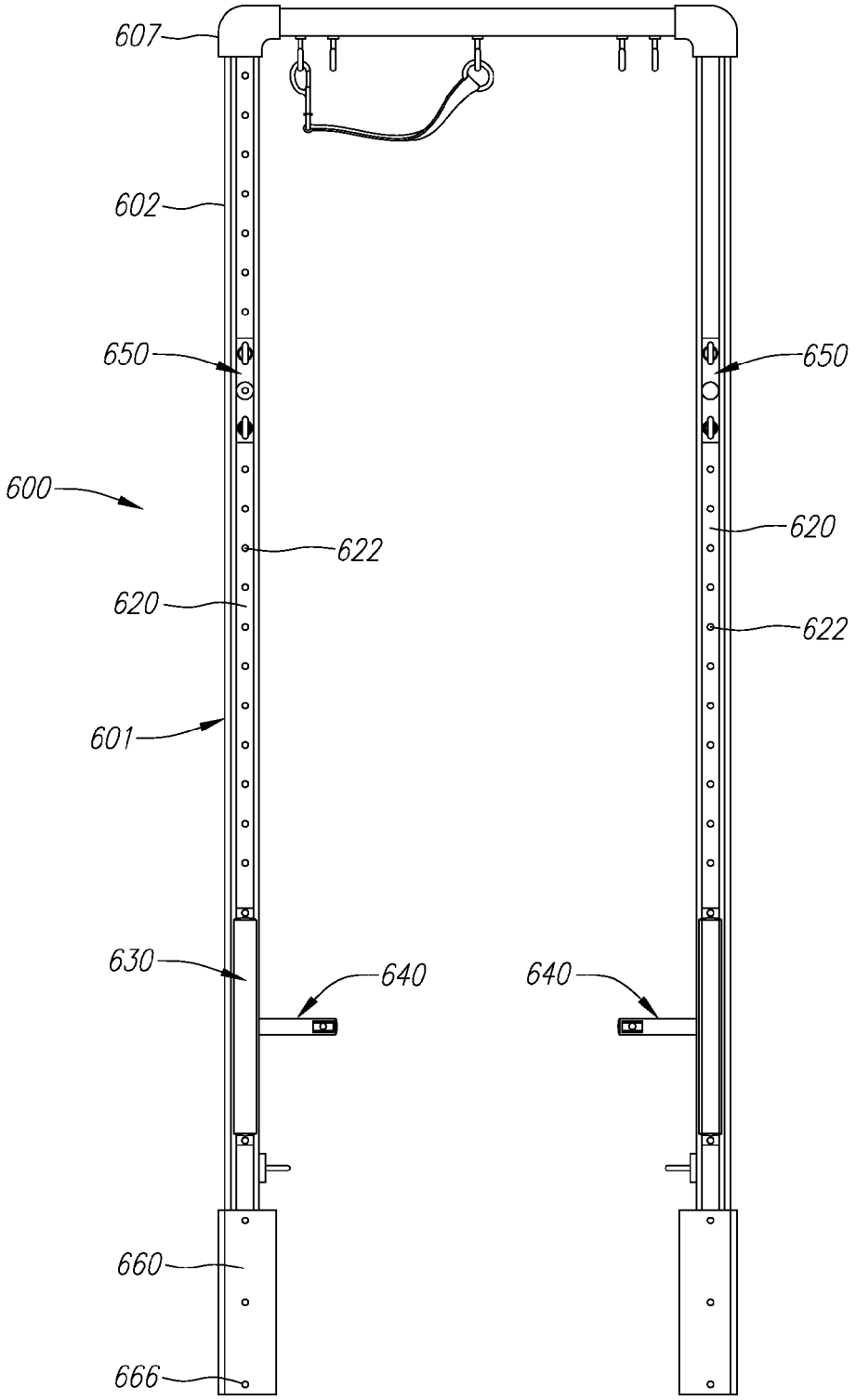
FIG. 5 is a front view of a tower.
Figure 6:
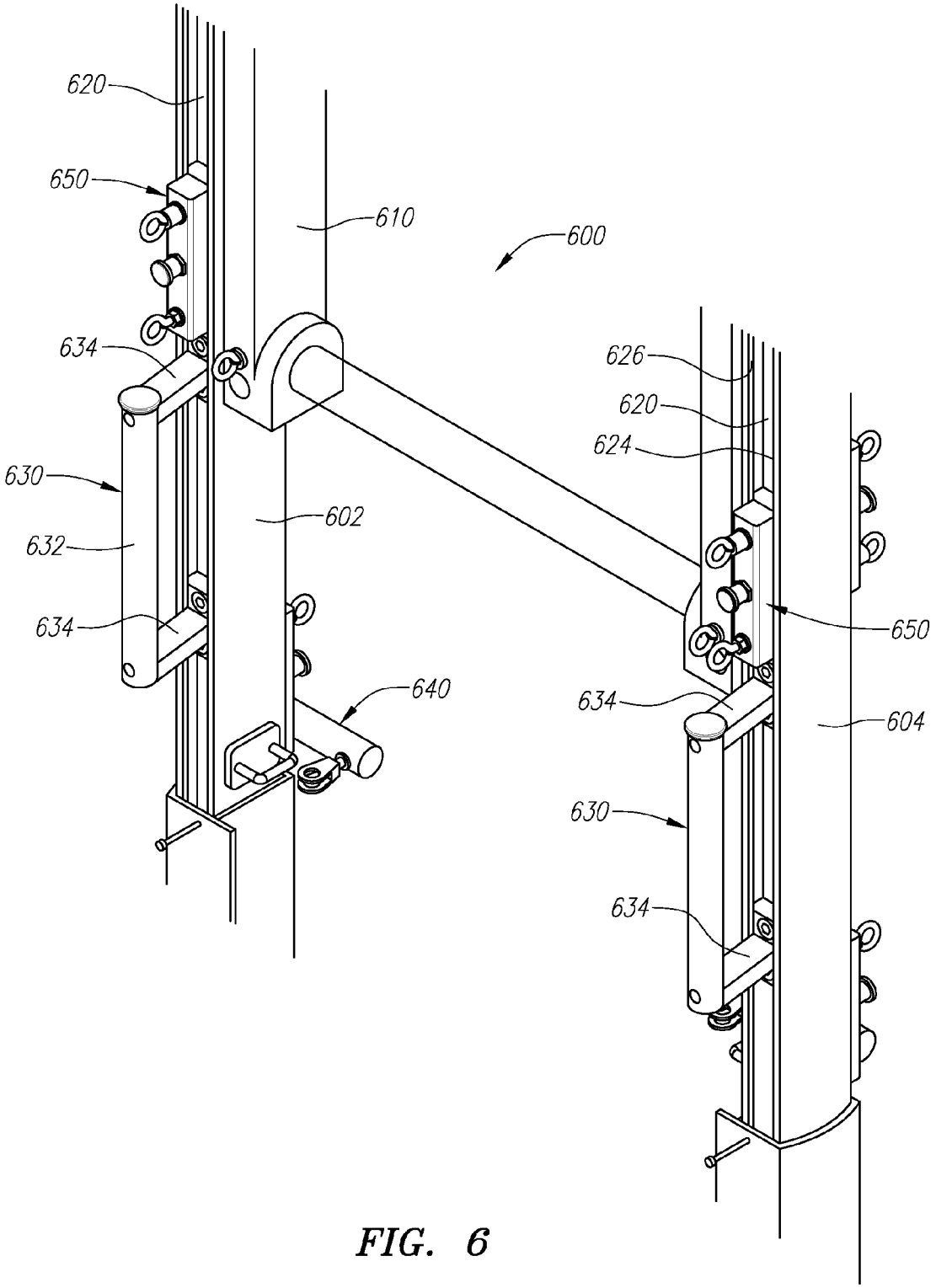
FIG. 6 is a detailed view of a handle area of a tower.

As shown in FIGS. 4 and 5, tower 600 may include frame 601 which may comprise left and right vertical members 602, 604 that may be attached at their top ends to horizontal member 606 via joints 607. Push through bar 610 (shown in FIG. 4) may be pivotally attached to tower frame 601 at pins 612 so that a user may push bar 610 with his or her hands or feet. Tower 600 may also include handles 630 for the user to grasp during certain exercises.

Figure 10:
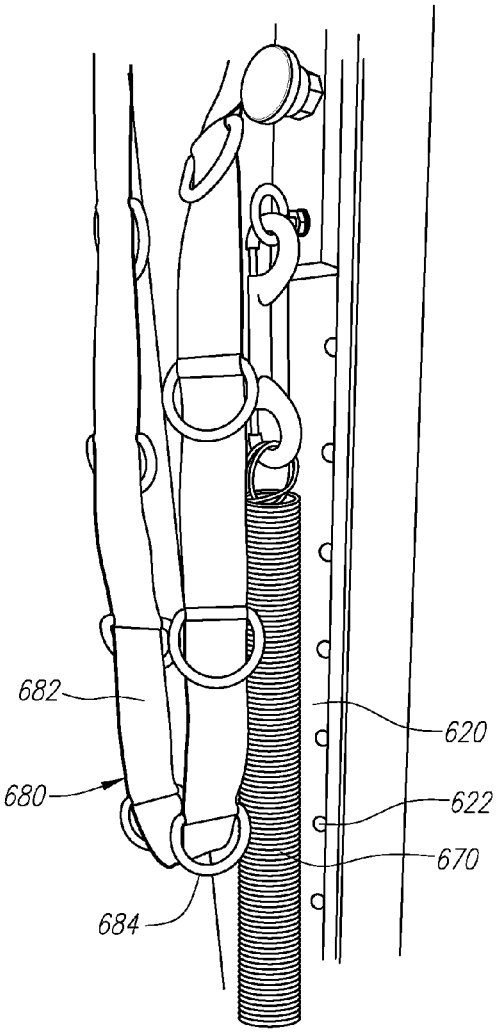
FIG. 10 is a detailed view of a safety strap, spring and tower.
Figure 11:
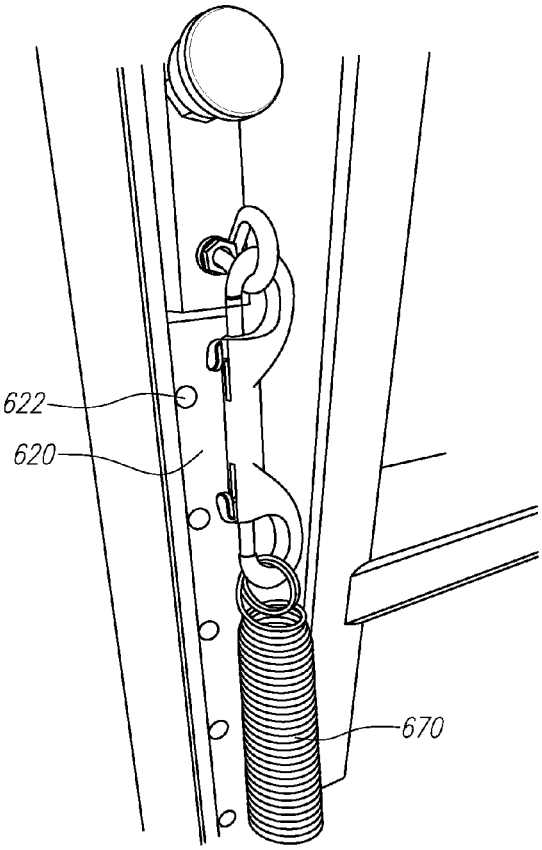
FIG. 11 is a detailed view of a tower.

Tower 600 may also include one or more sliding pulley adjustment members 640 that may also slide up and down vertical members 602, 604 as discussed later. Tower 600 may also include one or more spring adjustment mechanisms 650 that may slide up and down vertical members 602, 604 as discussed later. A spring 670 may be attached to spring adjustment mechanism 650 as shown in FIGS. 10-11.

Figure 7:
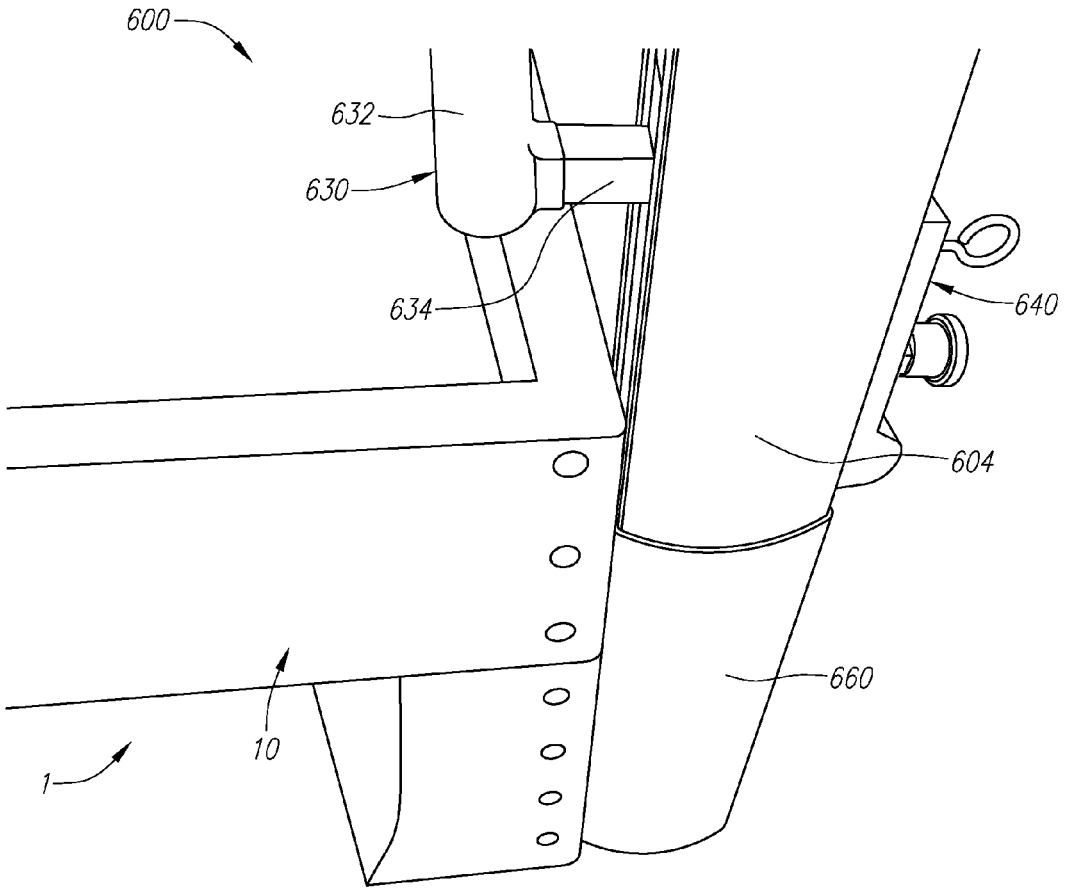
FIG. 7 is a detailed view of a tower connected to a reformer.
Figure 8:
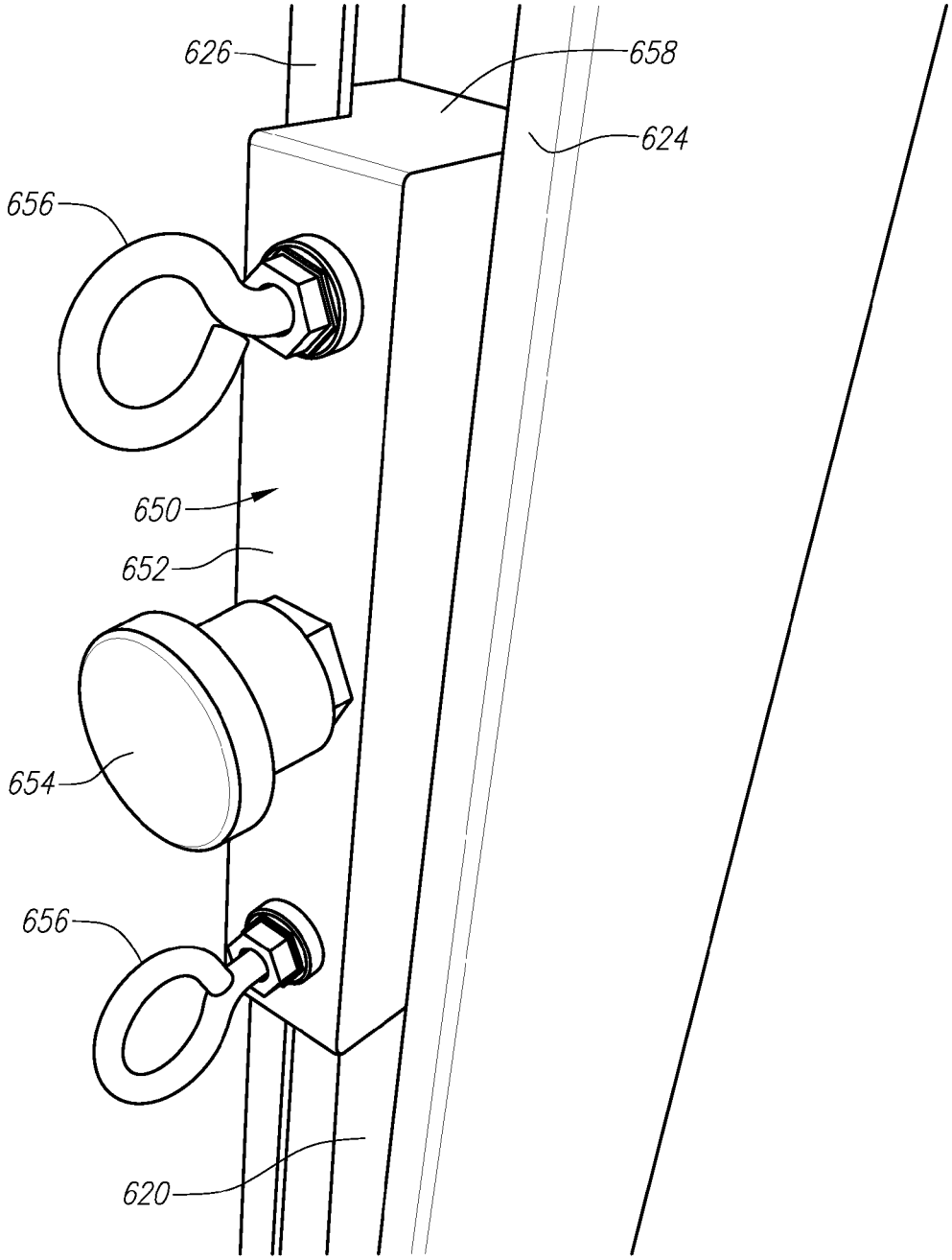
FIG. 8 is a detailed view of a spring adjustment mechanism of a tower.

Tower 600 may also include an attachment member 660 at or near the base of each vertical member 602, 604. Members 660 may be an extension of vertical members 602, 604 or may be a separate bracket or other component otherwise attached to tower frame 601. Each member 660 preferably includes bolts 662 or other means to attach tower 600 to the frame 10 of reformer 1 or to a floor and/or a wall. FIG. 7 shows tower 600 attached to reformer 1. As shown, it is preferred that tower 600 is firmly attached to reformer 1. This may be accomplished by using multiple bolts 662 or other attachment means that correspond with holes or other means on the reformer to receive the attachment means.

The different components of tower 600 are now more fully described. It is preferred that vertical members 602, 604 comprise extruded aluminum which yields a more rigid structure when compared to the tubular members used on certain existing towers. This preferably increases user safety. Members 602, 604 may include internal ribs in the extrusion process to provide increased rigidity. Horizontal member 606 may also comprise extruded aluminum. It should be noted, however, that other materials may be used and the invention is not limited to aluminum. Furthermore, members 602, 604, 606 may alternatively comprise separate pieces that are attached together to form each member. In any event, members 602, 604, 606 may include holes or brackets that allow their coupling by elbows 607.

The rigidity provided by tower 600 preferably provides better user feedback because there is little or no give in the tower. This preferably allows the user to experience the feel of just the progress being made in the exercise, e.g., by pushing on the push through bar 610, without also feeling any wobbling or movement by the tower relative to the reformer.

As best shown in FIGS. 5-11, vertical members 602, 604 may be formed such that channels 620 are formed therein. It is preferred that channels 620 are formed on both the front and back sides of members 602, 604 so that adjustable mechanisms 640, 650 may fit and slide therein on either side. Handles 630 may also fit within channels 620. As shown, channels 620 preferably include a plurality of holes 622 to receive pop-pins or other attachment means of handles 630, pulley adjustment mechanism 640 and spring adjustment mechanism 650.

Where members 602, 604 comprise extruded aluminum, channels may be formed along with the rest of the walls of members 602, 604 during the extrusion process. Where members 602, 604 alternatively comprise pieces attached together, a strip of metal with holes may be attached to other pieces that form the walls.

Vertical members 602, 604 and horizontal member 606 may be slightly curved and/or polished to provide a more inviting look to users. It is preferred that members 602, 604, 606 generally match each other in appearance. Joints 607 may also be curved and of the same similar exterior dimensions to provide a contiguous look. The edges of these components may also be rounded to provide an inviting appearance and also to avoid sharp edges for safety concerns.

Handles 630 are now more fully described with reference to FIGS. 4-7. As shown, handles 630 may include grip 632 which may be rubber dipped for a more tactile gripping surface while the user holds tower 600. Alternatively, grip 632 may be padded with foam or some other suitable material that preferably withstands contact with sweat. The user may grasp grip 632 when performing certain exercises. While the user may also grasp vertical members 602, 604, for certain exercises and/or users, it may be preferable that handles 630 are grasped. In this manner, additional exercises and/or user safety and comfort may be achieved.

Grips 632 may be attached to brackets 634 which may in turn be attached to vertical members 602, 604. This attachment may occur in channels 620. Brackets 634 may include bolts that are threaded into holes 622. However, other attachment means may be used. The location of handles 630 may be adjusted up or down on vertical members 602, 604 or may alternatively be fixed in a stationary location.

Spring adjustment mechanisms 650 are now more fully described with reference to FIGS. 4-6 and 8. As shown, spring mechanism may include block 652 which may include holes to receive a pop-pin 654 and eyelets 656. It is preferred that pop-pin 654 include a pin (not shown) that may extend into holes 622 of channel 620 to securely lock mechanism 650 into place. Eyelets 656 may be threaded into tapped holes of block 652. Springs 670 may be attached to eyelets 656.

Viewed as a cross-section from the top of vertical members 602, 604, channel 620 may resemble a T. That is, channels 620 may include outer and inner lips 624, 626 that are spaced apart at a particular distance that corresponds to the vertical portion of the T, as well as an interior portion where the distance between the walls of members 602, 604 is larger and corresponds to the horizontal portion of the T.

So that adjustment mechanism 650 is held by channel 620, block 652 may have a width that is slightly smaller than the distance between lips 624, 626. However, block 652 may be attached to a wider base block 658 that is sized slightly smaller than the larger distance between the interior walls of members 602, 604. As such, adjustment mechanism 650 is generally constrained by channel 620 but may still travel freely up and down.

To adjust spring adjustment mechanism 650, it is preferred that a user or instructor need simply pull on the pop pin so that the pin disengages from a hole 622. The user or instructor may then slide mechanism 650 up or down channel 620 to the next desired location. This is an advantage over existing towers where a spring must be disconnected from an eyelet and then connected to another eyelet. In sum, this allows one to easily and safely change the spring heights without disengaging the springs for a smoother transition between exercises. This provides for the enhanced flow of an overall pilates workout or other form of exercise by reducing the time needed to adjust the equipment between exercises, e.g., where the spring must be positioned at a different angle relative to the user. This also allows for the easy adjustment of spring position for users of different sizes or strengths.

As noted above, it is preferred that channels 620 are formed on both the front and rear of vertical members 602, 604. This allows that spring adjustment mechanisms 650 may be placed on both sides of tower 600, which in turn allows two people to use tower 600 to exercise at the same time. Given that space is at a premium in many pilates studios, allowing two users to exercise on one piece of equipment at the same time is advantageous. Furthermore, the sturdy nature of tower 600 preferably provides that one user will feel little or no effect of the other user exercising with the same tower at the same time.

Pulley adjustment mechanism 640 is now more fully described with reference to FIGS. 4-9. As shown, mechanism 640 may include block 642, pop-pin 644, spring eyelet 646 and base block 648, as well as arm 641 and pulley assembly 643. Pulley adjustment mechanism may travel up and down channel 620 in the same or similar fashion as spring adjustment mechanism 650. That is, block 642 may be sized slightly smaller than the distance between lips 624, 626, and may be attached to base block 648 which is within channel 620 and which is sized slightly smaller than the distance between the interior walls of members 602, 604. As such, pulley adjustment mechanism is generally constrained by channel 620 but may move freely up or down.

The position of pulley adjustment mechanism 640 may be adjusted similar to spring adjustment mechanism 650. That is, the knob of pop-pin 644 may be pulled so that its pin (not shown) is withdrawn from hole 622 in channel 620, thereby allowing vertical travel. When the new desired location is reached, the user or instructor may simply release the knob of pop-pin 644 and its pin will engage another hole 622. It should be noted that other types of pop pins or other means to engage members 602, 604 may be used.

Figure 9:
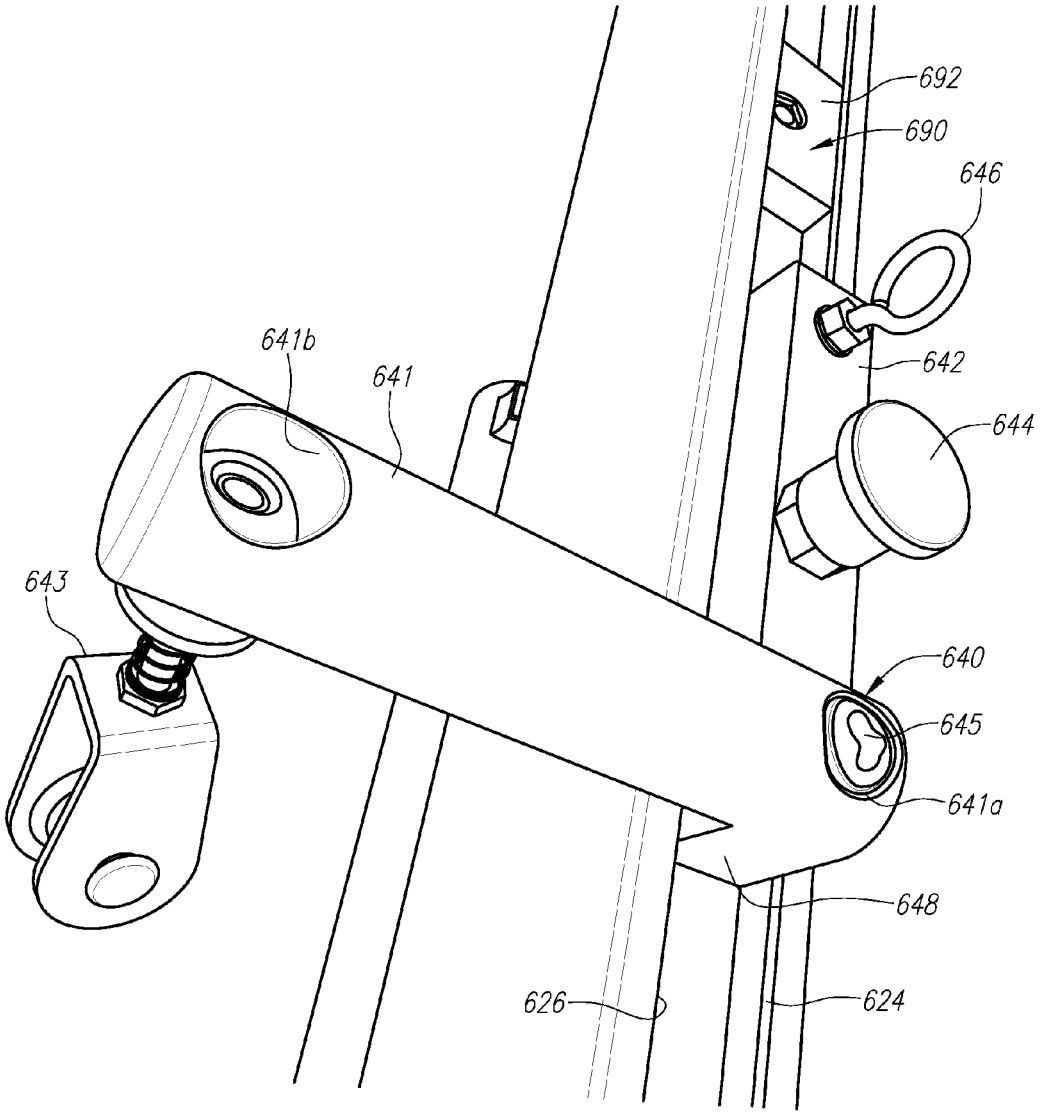
FIG. 9 is a detailed view of a pulley adjustment mechanism of a tower.

As best shown in FIG. 9, arm 641 may be attached to block 642 by bolt 645 or any other suitable attachment means. It is preferred that arm 641 have a curved and/or polished look similar to members 602, 604, 606 to provide an inviting appearance. It is also preferred that arm include recess 641*a* so that the head of bolt 645 or other attachment means generally fits within the contour of arm 641 to further provide an inviting appearance. Similarly, arm 641 may include recess 641*b* to accommodate the attachment of pulley mechanism 643. Suitable pulley mechanisms 643 are described in U.S. Ser. No. 11/652,806, the disclosure of which is expressly incorporated as if fully set forth herein.

It is preferred that the knobs of pop-pins 644, 654 are similar so that their adjustment feels uniform to the user or instructor. This also provides a uniform, inviting appearance to the equipment. Blocks 642, 652 may be similar in appearance as well. Furthermore, eyelets 646, 656 may generally be the same. The uniformity of these component pieces also facilitates manufacturing and reduces cost since numerous components with different dimensions may not need to be produced.

Channels 620 may include stops 690 as shown in FIG. 9 that may be bolted into one of the holes 622 and that may include block 692. It is preferred that stop 690 may limit the travel of either pulley adjustment mechanism 640 or spring adjustment mechanism 650.

Additional aspects related to the appearance of exercise equipment incorporating the current invention are now described with reference to FIG. 10. Typically, a tower will include a safety chain attached to the tower frame and the push through bar. The safety chain serves to limit the travel of the push through bar and to avoid the situation where the push through bar hits the user. Such chains may be unsightly and noisy. As shown in FIG. 10, however, the current invention preferably includes a safety strap 680 that may include webbing 682 and loops 684. Preferably, loops 684, that may engage connectors attached to tower 600, are sewn into webbing 682 to provide a softer, more inviting look to the exercise equipment. The use of fabric webbing also preferably avoids the noise associated with clanging safety chains.

Figure 12C:
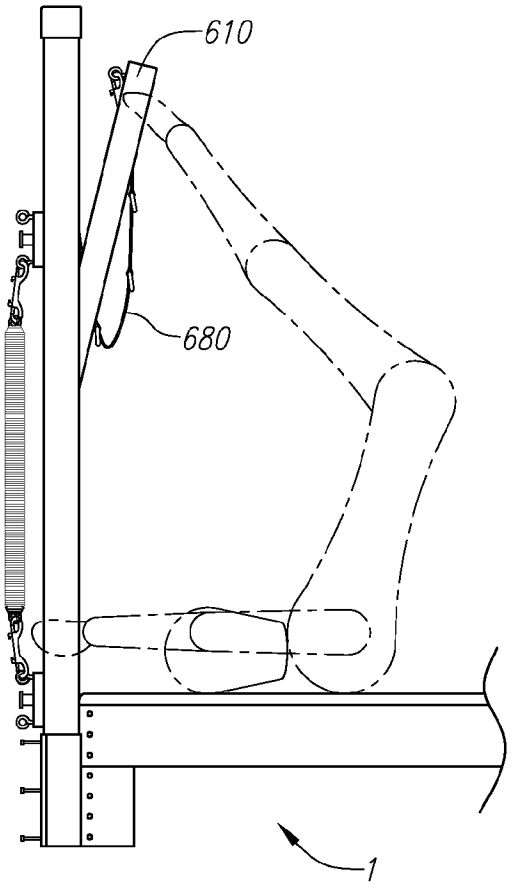
FIGS. 12A, 12B and 12C show a tower in use.
Figure 12B:
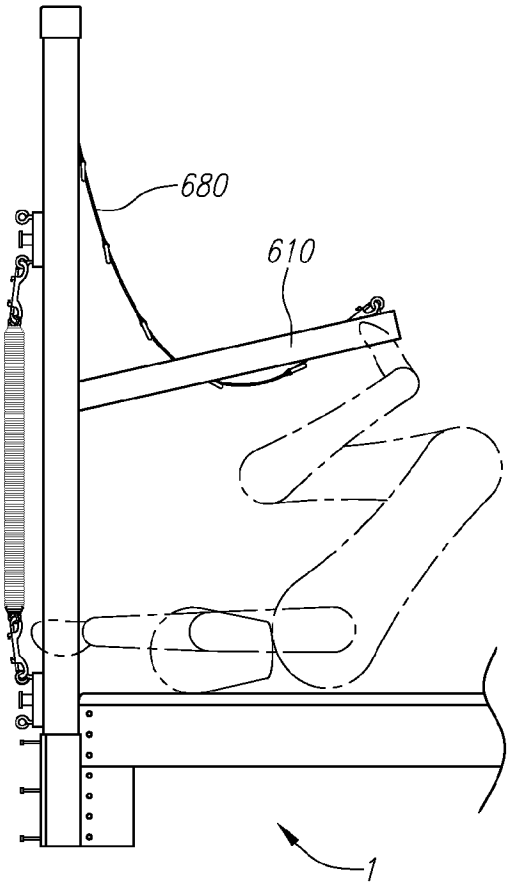
Figure 12A:
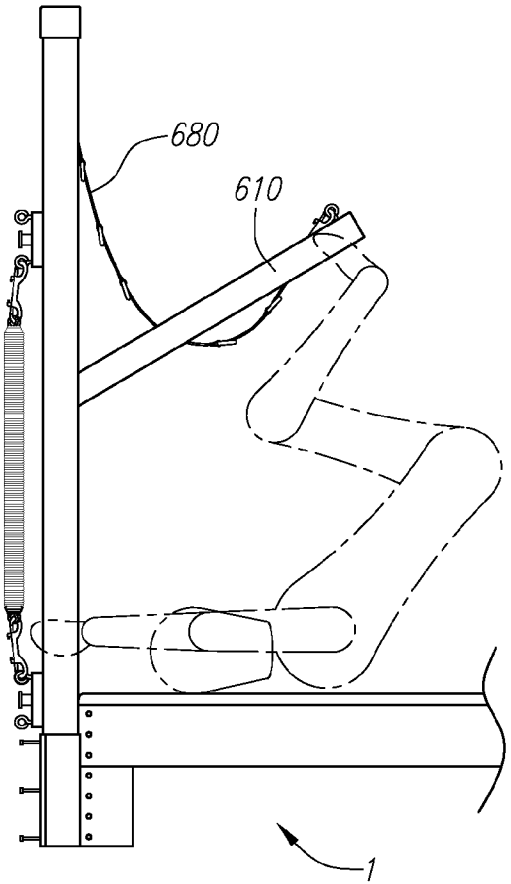

The use of safety straps 680 is shown in FIGS. 12A-12C where strap 680 is shown to become more taut as push through bar 610 nears the user. As also shown in the figures, various other straps or spring holding mechanisms may be attached at other locations on tower 600.

Figure 14:
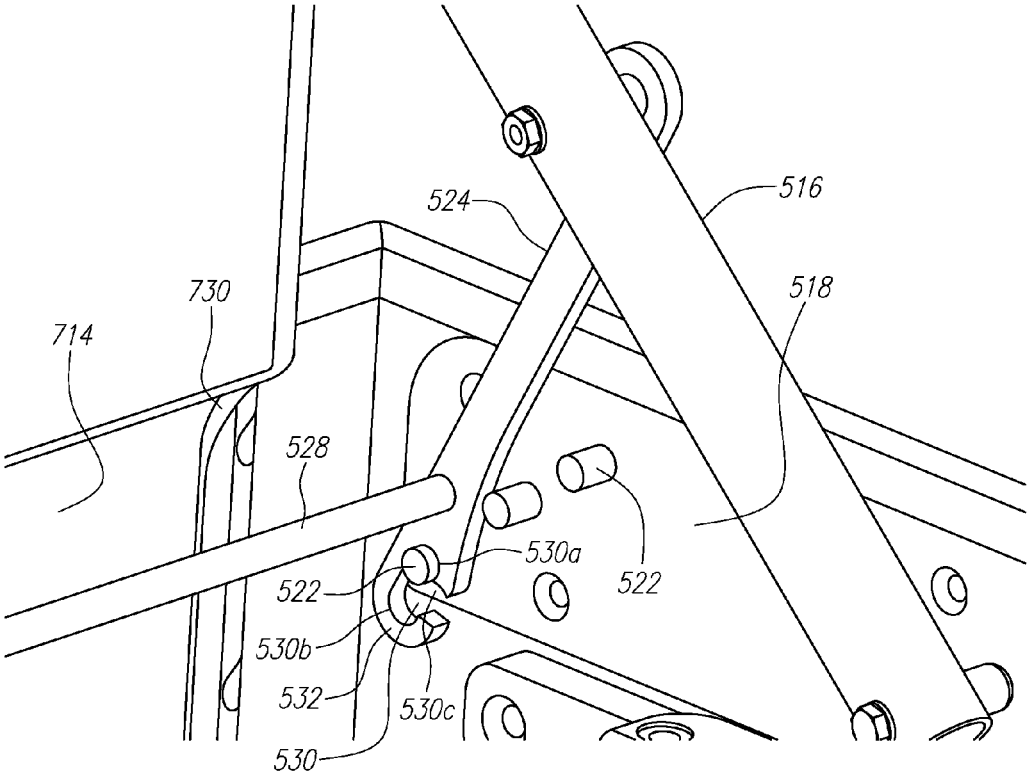
FIG. 14 is a detailed view of a foot bar assembly.
Figure 15:
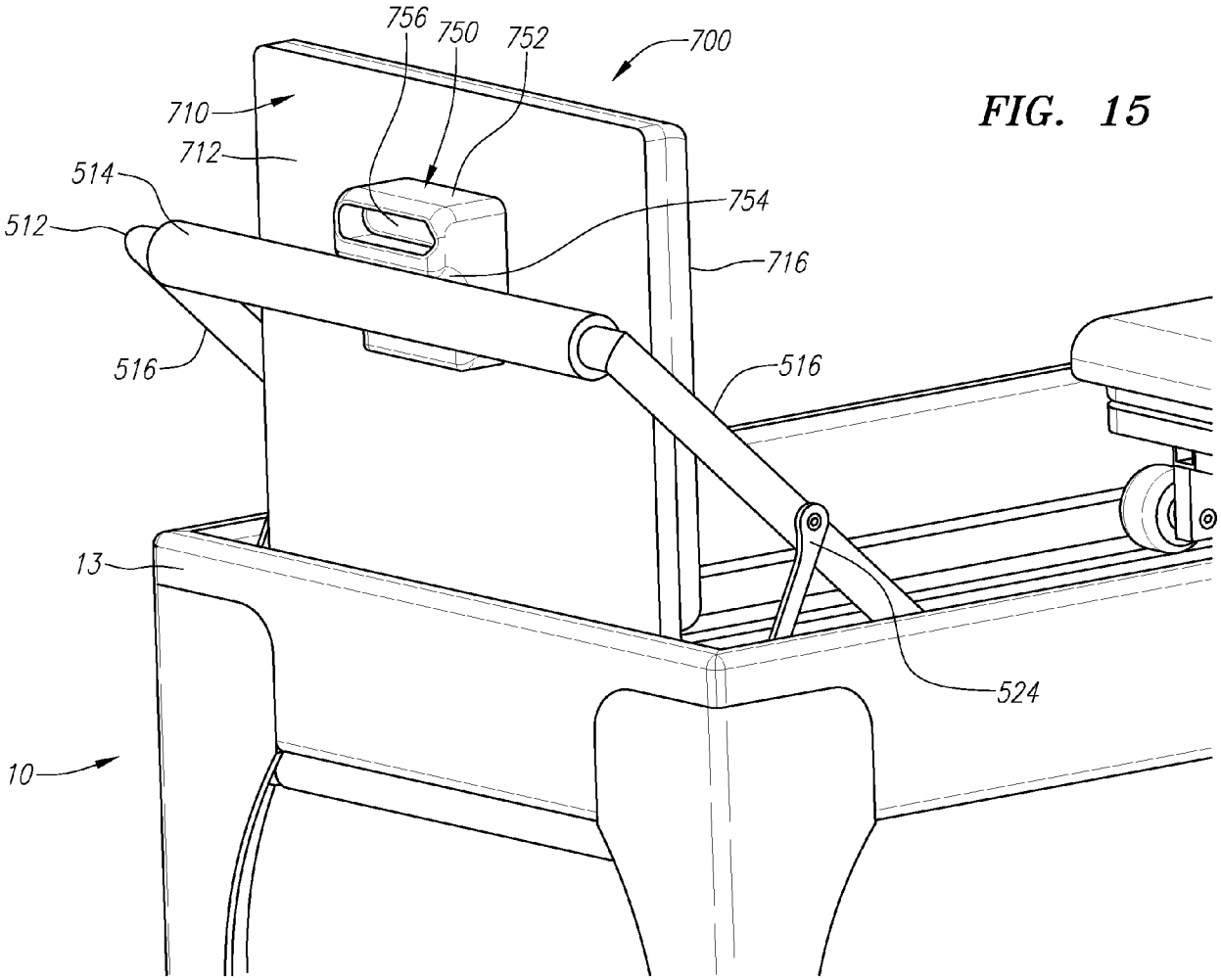
FIG. 15 is a rear view of a foot bar assembly and jump board.

An aspect of the current invention involving a foot bar assembly for an exercise table, such as a reformer, is now described in more detail with reference to FIGS. 13-15. Foot bar assembly 510 may include foot bar 512 that includes a cushion 514 mounted thereon. The cushioned portion 514 may be made of rubber or other material similar to the other surfaces which the user contacts as described above. This preferably achieves the desired pliability for comfort and texture to provide the friction needed to keep the user's feet safely in place during an exercise routine. This also preferably contributes to an inviting appearance of reformer 1.

Foot bar 512 may be attached at its ends to arms 516 that are in turn pivotally mounted to frame 10 of reformer 1. To this end, mounting plates 518 may be mounted to the rails of either side of frame 10 and may include pin 520 or other component suitable for allowing the pivotal connection between arms 516 and frame 10. As discussed later in more detail, plates 518 may include one or more mounting pegs 522.

Arms 516 are also preferably connected to adjusting links 524 through pivotal connection 526. Adjusting links 524 preferably include a cutout 530 at or near its end as well as a captive hook 532. As discussed in more detail below, cutout 530 engages any of the pegs 522 for pivotally adjusting foot bar 512 radially about pivotal connection 520. This engagement locks foot bar 512 in a position for the desired exercise. Adjusting links 524 are preferably connected together by link bar 528, which preferably maintains the two links 524 in parallel to each other, and which may be used to adjust links 524 from one set if pegs 522 to another.

The engagement between adjusting links 524 and pegs 520 is now more fully described with reference to FIGS. 13 and 14. When in use during an exercise where the user lays on carriage 16 and moves away from foot bar 512, the user's feet will generally be pushing horizontally against foot bar 512. As another example, the user's hands may press down on foot bar 512 when the user is, for example, in the plank position.

In either case, as well as with other exercises, cutout 530 preferably assures that links 524 remain engaged with pegs 522. This occurs because, when in use, foot bar 512 generally presses downward on links 524, which in turn press downward on pegs 522 so that the upper portion 530*a* of cutout 530 engages peg 522. If foot bar 512 were inadvertently pulled or pushed in the opposite direction, foot bar 512 would move only a slight distance until the lower portion 530*b* and captive hook 532 would engage peg 522 thus preventing it from moving further, and also preventing it from becoming disengaged.

The adjustment of foot bar 512 is now more fully described. In order to promote safety and to enhance the sturdy feel provided by the current invention, it is preferred that the user or instructor use a two-handed operation to adjust foot bar 512. To that end, the user or instructor may slightly move foot bar 512 which results in rotation thereof. The user or instructor may then lift and rotate adjustment links 524 by, e.g., pulling up on link 528 so that pegs 522 pass through the opening 530*c* of cutout 530 and adjustment links 524 are fully disengaged from pegs 522. Alternatively, the user or instructor may lift and rotate links 524 by pulling up on one of the links which will effect movement of the other link due to their being connected by link 528.

Once adjustment links 524 are clear of the set of pegs 522, foot bar 512 may be adjusted to engage another set of pegs 522 by manipulating foot bar assembly 510 so that another set of pegs 522 pass through opening 530*c* of cutouts 530 of adjustment links 524.

If the user or instructor tried to adjust foot bar 512 by moving only foot bar 512 without also moving links 524, captive hook 532 would preferably engage peg 522 thereby stopping the motion. It is preferred that the two-handed approach to adjustment helps facilitate safety by avoiding disengagement by any type of inadvertent pushing or pulling on foot bar 512 or other part of foot bar assembly 510. Again, this is accomplished by virtue of cutout 530 and captive hook 532 which generally surround the peg 522 is being engaged.

An aspect of the current invention relating to an improved jump board and the manner in which it may be attached to the exercise equipment is now discussed with reference to FIGS. 13-15. Jump board 700 may include base 710 that in turn may include an upper portion 712 and lower portion 714. Upper and lower portions 712, 714 may comprise one contiguous piece of wood or other suitable material that may withstand the forces of users jumping off and landing on jump board 700.

A jump board cushion 716 may be mounted to upper portion 712 to accommodate the user's feet. Jump board cushion 716 preferably has the same look as the other components described above which the user contacts. Jump board cushion 716 may also have texture to avoid the user's feet from slipping upon contacting jump board 700, and to improve its tactile feel to the user.

The manner in which jump board 700 is attached to reformer 1 is now more fully described. A pair of L-shaped flanges 730 may be attached to the interior of foot member 13 of frame 10 of reformer 1. Flanges 730 may be aluminum or any other suitable sturdy material. Flanges may be attached to the interior of frame 10 by screws, bolts or any other suitable attachment means.

When flanges 730 are attached to the interior of frame 10, a gap preferably exists between the flange and interior frame surface that is about the same as the thickness of lower portion 714 of base 710. Flanges 730 are also spaced a distance apart from each other at a distance that is about the same as the width of lower portion 714. As such, a pocket or envelope is created by flanges 730 and frame 10.

To mount jump board 700 to reformer 1, lower portion 714 may be dropped into the pocket or envelope formed by flanges 730 and frame 10 described above. Lower portion 714 may have relief cuts so that a portion of its width is cut from either side so that it is narrower than upper portion 712 and so that it has about the same width as the envelope. There may also be a transition 718 between upper and lower portions where the width of base 710 increases from lower portion 714 to upper portion 712. Transition 718 may rest upon the tops of flanges 730 when jump board 700 is dropped into the pocket.

Lower portion 712 may also have cutouts, e.g., a trough (not shown), cut out from its surface that may accommodate edge of flanges 730. In other words, the edges of flanges 730 may protrude into the thickness of lower portion 714 to provide increased stability. It is preferred that lower portion 714 snugly fit within the envelope created by frame 10 and flanges 730 to provide increased rigidity, feel and safety. However, this fit is preferably not overly tight so that jump board 700 may be removed from the envelope without difficulty.

The manner in which jump board 700 is further secured by foot bar assembly is now further described with reference to FIGS. 13 and 15. As shown, bumper 750 may be mounted to the rear side of jump board base 710. Bumper 750 may include a base 752 having a foot bar receptacle 754 and handle 756. Receptacle 754 is sized to receive the cushioned section of foot bar 512. As such, receptacle 754 is preferably cylindrical, and receptacle 754 may be shaped so that its circumference extends more than 180 degrees so as to grip foot bar 712 and provide a solid connection between jump board 700 and reformer 1. This in turn provides a better feel to the user.

Foot bar assembly 510 thus laterally supports jump board 700 when the user lands on the cushioned portion 716 and jumps off. This support serves to stiffen the entire jump board assembly and provides better feel for the user. Furthermore, it provides more security and safety.

Bumper 750 may also include handle 756 that may be grasped by the user or instructor to lift jump board 700 out of reformer 1 when it is desired to remove jump board 700. Handle 756 may also help an individual drop jump board 700 into the envelope between frame 10 and flanges 730 as discussed above.

The jump board 700 of the current invention represents an advance over prior jump boards regarding the ease in which it may be attached and removed to the reformer. That is, instead of having to screw knobs at the base of the jump board into the frame as currently exists with many reformers, jump board 700 need only be dropped into the envelope while fitting foot bar 712 into receptacle 754. Furthermore, the engagement by foot bar assembly 510 provides a mounting device higher up than which occurs with most existing reformers, thereby providing increased stability. Still further, jump board 700 may be easily lifted out of the envelope and disengaged from receptacle 754 instead of having to unscrew knobs from the frame.

While various embodiments of an exercise table and aspects thereof have been presented in the foregoing disclosure, numerous modifications, alterations and alternate embodiments may be contemplated by those skilled in the art and may be utilized in accomplishing the various aspects of the present invention. Thus, it is to be clearly understood that this description is made only by way of example and not as a limitation on the scope of the invention.

What is claimed is:

1. An improved reformer, comprising:

a frame having a head end and a foot end;

a carriage that moves between the head end and foot end;

a pair of flanges mounted to an interior surface of the foot end of the frame that faces the carriage; and a jump board that is removably positioned adjacent to the interior surface of the foot end of the frame by engaging the pair of flanges.

2. The reformer of claim 1, further comprising a foot bar assembly that is secured to the frame and that secures the jump board when adjusted to a first height.

3. The reformer of claim 2, wherein the foot bar assembly includes two arms each attached to the frame at their first end and attached to a foot bar at their second end, and wherein the jump board engages the foot bar when the foot bar assembly is adjusted to the first height.

4. The reformer of claim 3, wherein the jump board includes a receptacle to receive the foot bar.

5. The reformer of claim 4, where the receptacle includes a handle.

6. The improved reformer of claim 1, wherein the jump board further comprises an upper portion and a lower portion, and wherein the lower portion engages the pair of flanges.

7. The improved reformer of claim 6, where the pair of flanges are spaced apart by a distance, and the lower portion of the jump board has a width that is substantially equal to the distance between the pair of flanges.

8. The improved reformer of claim 7, wherein the width of the lower portion of the jump board is narrower than the width of the upper portion of the jump board.

9. The improved reformer of claim 6, wherein the pair of flanges defines a gap between the frame and the flanges, and wherein the lower portion of the jump board has a thickness that is substantially the same as the gap.

10. The improved reformer of claim 1, wherein the jump board includes a cushion.

* * * * *